US010266232B1

(12) United States Patent
Colten

(10) Patent No.: US 10,266,232 B1
(45) Date of Patent: Apr. 23, 2019

(54) COLLAPSIBLE WATER VESSEL

(71) Applicant: Lewis Colten, Framingham, MA (US)

(72) Inventor: Lewis Colten, Framingham, MA (US)

( * ) Notice: Subject to any disclaimer, the term of this patent is extended or adjusted under 35 U.S.C. 154(b) by 0 days.

(21) Appl. No.: 15/805,262

(22) Filed: Nov. 7, 2017

(51) Int. Cl.

| | |
|---|---|
| ***B63B 7/02*** | (2006.01) |
| ***B63B 35/71*** | (2006.01) |
| ***A45F 4/10*** | (2006.01) |
| ***B63B 3/26*** | (2006.01) |
| ***B63H 16/04*** | (2006.01) |

(52) U.S. Cl.
CPC ..... *B63B 7/02* (2013.01); *A45F 4/10* (2013.01); *B63B 3/26* (2013.01); *B63B 35/71* (2013.01); *B63H 16/04* (2013.01); *B63B 2231/52* (2013.01); *B63B 2709/00* (2013.01)

(58) Field of Classification Search
CPC .. B63B 7/02; B63B 3/26; B63B 35/71; B63B 2231/52; B63B 2709/00; B63H 16/04; A45F 4/10
See application file for complete search history.

(56) References Cited

U.S. PATENT DOCUMENTS

| | | | | |
|---|---|---|---|---|
| 4,274,170 | A * | 6/1981 | Simpson | B63B 7/06 114/347 |
| 5,499,594 | A * | 3/1996 | Bullock | B63B 7/02 114/354 |
| 5,875,731 | A * | 3/1999 | Abernethy | B63B 7/06 114/347 |
| 5,964,178 | A * | 10/1999 | Gonda | B63B 7/06 114/347 |
| 5,967,072 | A * | 10/1999 | Leary | B63B 7/02 114/73 |
| 6,263,827 | B1 | 7/2001 | Szigeti | |
| 6,371,042 | B1 * | 4/2002 | Abernethy | B63B 7/06 114/347 |
| 7,143,716 | B2 | 12/2006 | Modi | |
| 7,383,787 | B2 * | 6/2008 | Flood | B63B 7/06 114/347 |
| D644,164 | S | 8/2011 | Cross, Sr. | |
| 8,656,855 | B2 | 2/2014 | Flood | |
| 2010/0024710 | A1 | 2/2010 | Malone | |
| 2012/0160149 | A1 * | 6/2012 | Flood | B63B 7/082 114/353 |
| 2013/0200115 | A1 | 8/2013 | Huber | |
| 2014/0080367 | A1 * | 3/2014 | Gariepy | B63B 5/24 440/6 |
| 2015/0230591 | A1 | 5/2015 | Maybin | |

FOREIGN PATENT DOCUMENTS

| | | | |
|---|---|---|---|
| WO | 2012092050 | A2 | 7/2012 |

* cited by examiner

*Primary Examiner* — Anthony D Wiest

(57) ABSTRACT

The collapsible water vessel is deployed as either a kayak or a canoe. The collapsible water vessel is portable and is stored as or in a backpack. The collapsible water vessel deploys with a bottom configuration selected from the group consisting of a normal bottom, a deep V bottom, and a flat bottom. The collapsible water vessel comprises an outer frame, one or more ribs, one or more seats, an outer shell, a flooring bladder, and a plurality of elastic cords. The outer shell provides a barrier between the interior of the collapsible water vessel and the water within which the collapsible water vessel is placed. The outer frame, the one or more ribs, the one or more seats, the flooring bladder, and the plurality of elastic cords form the physical structure upon which the outer shell attaches.

17 Claims, 8 Drawing Sheets

COLLAPSIBLE WATER VESSEL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation including ships and other waterborne vessels, more specifically, a collapsible, foldable, inflatable or like vessel having both: 1) parts of non-rigid materials; and, 2) parts of rigid materials.

SUMMARY OF INVENTION

The collapsible water vessel is a portable boat that can be stored as or in a backpack. The collapsible water vessel is configured for use in water. The collapsible water vessel can be deployed as either a kayak or a canoe. The collapsible water vessel can be deployed with a bottom configuration selected from the group consisting of a normal bottom, a deep V bottom, and a flat bottom. The collapsible water vessel comprises an outer frame, one or more ribs, one or more seats, an outer shell, a flooring bladder, a plurality of paddles, and a plurality of elastic cords. The outer shell provides a barrier between the interior of the collapsible water vessel and the water within which the collapsible water vessel is placed. The outer frame, the one or more ribs, the one or more seats, the flooring bladder, and the plurality of elastic cords form the physical structure upon which the outer shell attaches. The plurality of paddles provides motive power for the collapsible water vessel.

These together with additional objects, features and advantages of the collapsible water vessel will be readily apparent to those of ordinary skill in the art upon reading the following detailed description of the presently preferred, but nonetheless illustrative, embodiments when taken in conjunction with the accompanying drawings.

In this respect, before explaining the current embodiments of the collapsible water vessel in detail, it is to be understood that the collapsible water vessel is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the collapsible water vessel.

It is therefore important that the claims be regarded as including such equivalent construction insofar as they do not depart from the spirit and scope of the collapsible water vessel. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
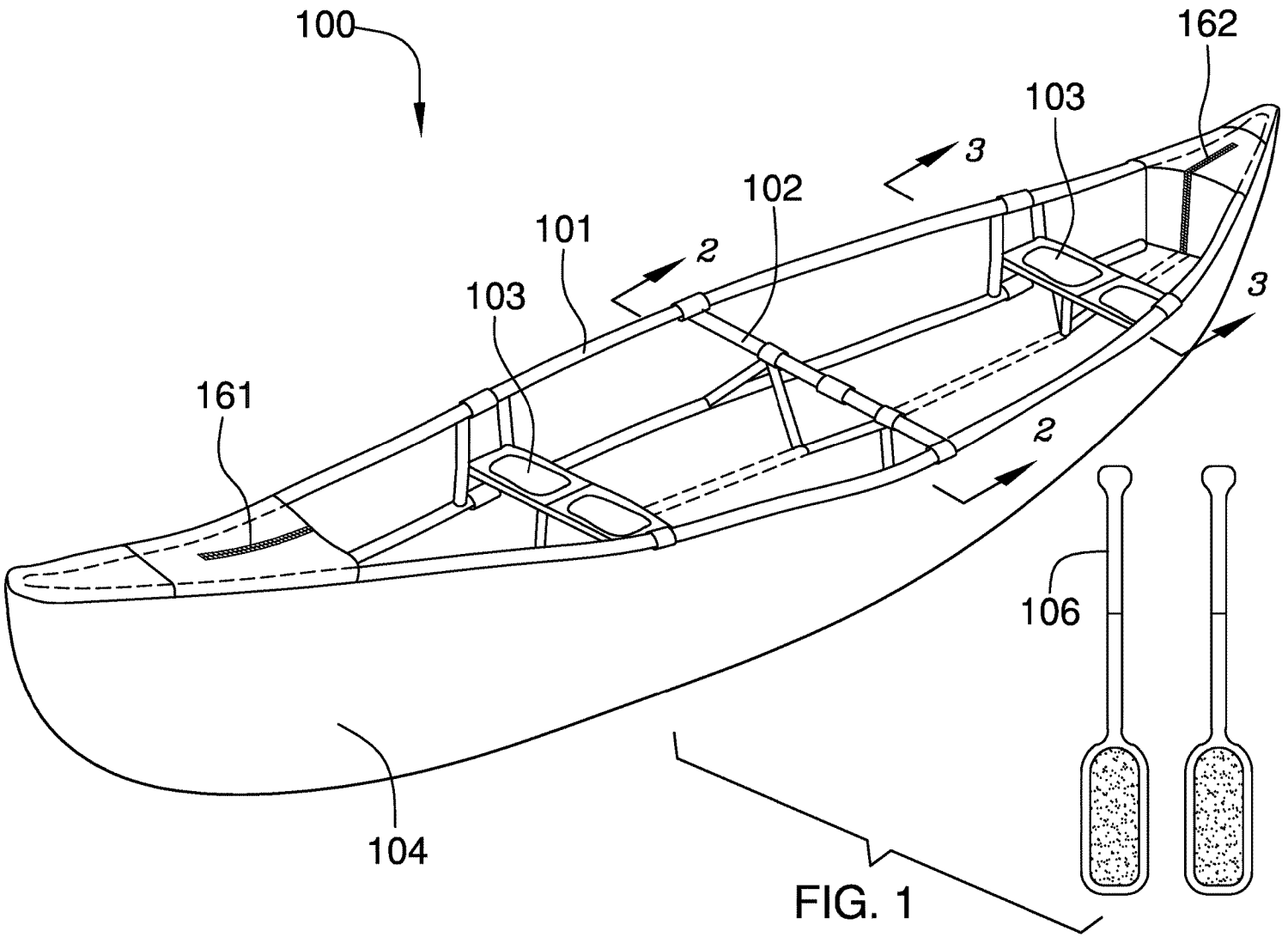
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 9.

The collapsible water vessel 100 (hereinafter invention) is a portable boat that can be stored as or in a backpack. The invention 100 is configured for use in water. The invention 100 can be deployed as either a kayak or a canoe. The invention 100 can be deployed with a bottom configuration selected from the group consisting of a normal bottom, a deep V bottom, and a flat bottom. The invention 100 comprises an outer frame 101, one or more ribs 102, one or more seats 103, an outer shell 104, a flooring bladder 105, a plurality of paddles 106, and a plurality of elastic cords 107. The outer shell 104 provides a barrier between the interior of the invention 100 and the water within which the invention 100 is placed. The outer frame 101, the one or more ribs 102, the one or more seats 103, the flooring bladder 105, and the plurality of elastic cords 107 form the physical structure upon which the outer shell 104 attaches. The plurality of paddles provides motive power for the invention 100.

The outer frame 101 is a rigid structure that supports the exterior of the invention 100. The outer frame 101 comprises a plurality of fiberglass rods 110, a bow yoke 116, a stem yoke 117, and a bow winch 118 and an aft winch 119.

Each of the plurality of fiberglass rods 110 comprises a plurality of fiberglass pipes 191 and an elastic cord selected from the plurality of elastic cords 107. Each of the plurality of fiberglass pipes 191 is a flexible fiberglass pipe. The plurality of elastic cords 107 comprises a first elastic cord 181, a second elastic cord 182, a third elastic cord 183, a fourth elastic cord 184, and a fifth elastic cord 185. The plurality of fiberglass rods 110 comprises a first rod 111, a second rod 112, a third rod 113, a fourth rod 114, and a fifth rod 115. The first rod 111 is further defined with a first end 201 and a second end 202. The second rod 112 is further defined with a third end 203 and a fourth end 204. The third rod 113 is further defined with a fifth end 205 and a sixth end 206. The fourth rod 114 is further defined with a seventh end 207 and an eighth end 208. The fifth rod 115 is further defined with a ninth end 209 and a tenth end 210.

Figure 4:
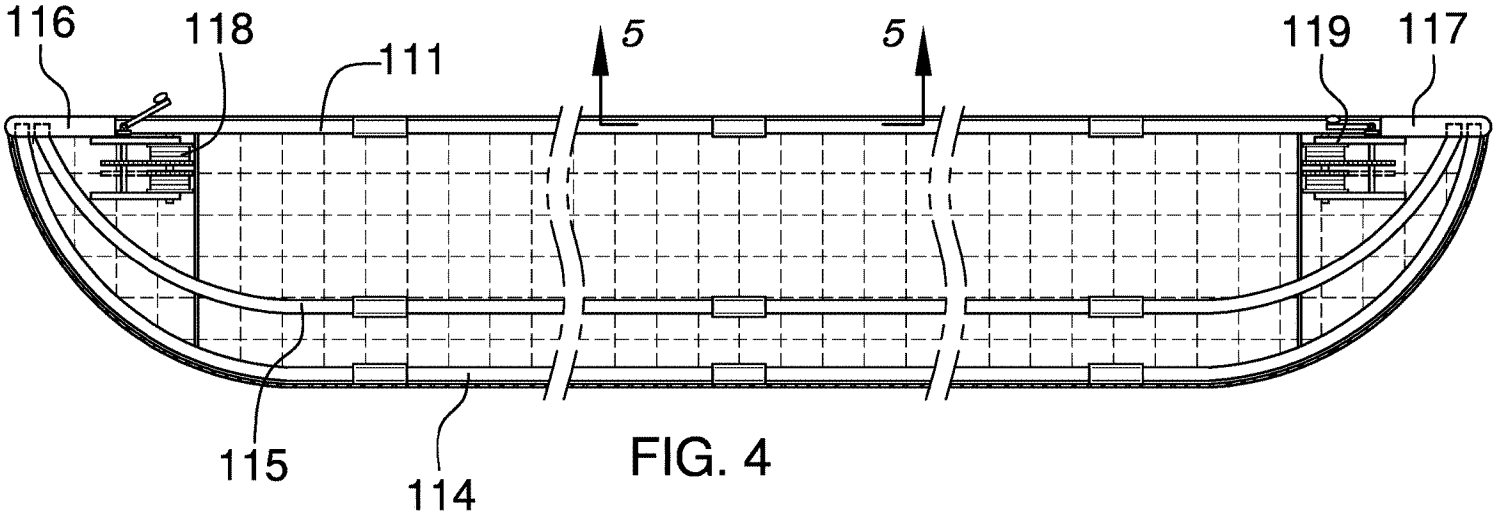
FIG. 4 is a side view of an embodiment of the disclosure.
Figure 5A:
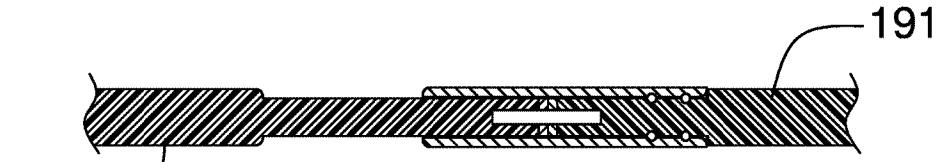
FIG. 5*a* is a cross-sectional view of an embodiment of the disclosure across 5-5 as shown in FIG. 4.
Figure 5B:
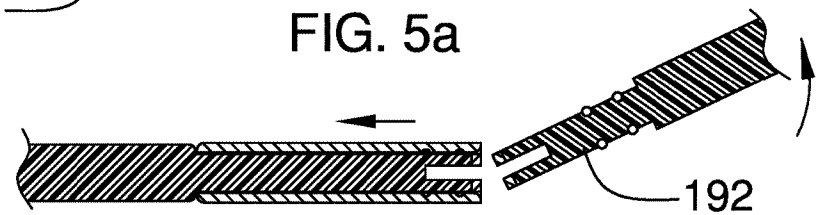
FIG. 5*b* is a cross-sectional view of an embodiment of the disclosure across 5-5 as shown in FIG. 4.
Figure 9:
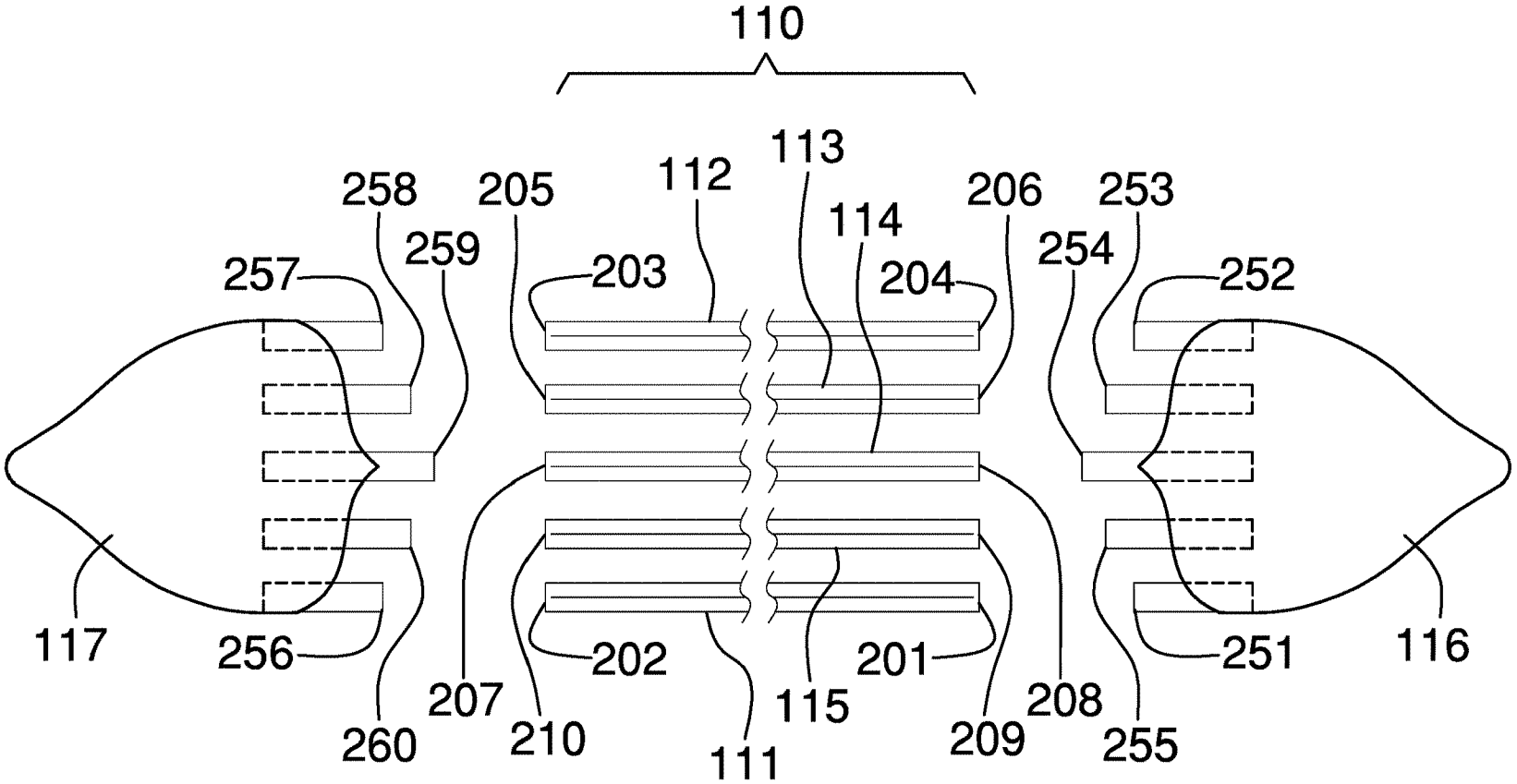
FIG. 9 is a detail view of an embodiment of the disclosure.

As shown most clearly in FIGS. 4 and 9, the bow yoke 116 is a custom made structure that forms the bow of the invention 100. The bow yoke 116 is used to anchor an end of each of the plurality of fiberglass rods 110 during the assembly of the invention 100. The bow yoke 116 is further defined with a first port 251, a second port 252, a third port 253, a fourth port 254, and a fifth port 255.

As shown most clearly in FIGS. 4 and 9, the stem yoke 117 is a custom made structure that forms the stem of the invention 100. The stem yoke 117 is used to anchor an end of each of the plurality of fiberglass rods 110 during the assembly of the invention 100. The stem yoke 117 is further defined with a sixth port 256, a seventh port 257, an eighth port 258, a ninth port 259, and a tenth port 260.

Each of the plurality of elastic cords 107 is a readily and commercially available cord that comprises an elastic material that allows the plurality of elastic cords 107 to stretch when a force is applied to any of the plurality of elastic cords 107. Each of the plurality of fiberglass rods 110 is a flexible tubular structure made of fiberglass. The span of the length of each of the plurality of fiberglass rods 110 can vary. Any individual fiberglass rod selected from the plurality of fiberglass rods 110 comprises a plurality of fiberglass pipes 191 and an elastic cord selected from the plurality of elastic cords 107. Each of the plurality of fiberglass pipes 191 is a hollow pipe. The plurality of fiberglass pipes 191 that make up the selected fiberglass rod can be joined end to end in a tent pole configuration in order to from the selected fiberglass rod wherein the ferrule 192 of a first selected fiber glass pipe is inserted into the hollow center of a second fiberglass pipe. The selected elastic cord is threaded through one or more grommets attached to each of the plurality of fiberglass pipes 191 such that: 1) the selected elastic cord will hold the selected fiberglass rod together; and, 2) the selected elastic cord can be tightened by the a winch selected from the group consisting of the bow winch 118 or the aft winch 119 such that the structure of the outer frame 101 is rigidly formed.

The bow winch 118 is a commercially available winch that is used to tighten each of the plurality of elastic cords 107 in a manner that secures each of the plurality of fiberglass rods 110 to both the bow yoke 116 and the stem yoke 117. The aft winch 119 is a commercially available winch that is used to tighten each of the plurality of elastic cords 107 in a manner that secures each of the plurality of fiberglass rods 110 to both the bow yoke 116 and the stem yoke 117. The use of a winch to tighten lines is well known and documented in the mechanical arts.

The assembly of the outer frame 101 is described in the following 3 paragraphs.

The first elastic cord 181 is threaded along the first rod 111. The second elastic cord 182 is threaded along the second rod 112. The third elastic cord 183 is threaded along the third rod 113. The fourth elastic cord 184 is threaded along the fourth rod 114. The fifth elastic cord 185 is along the fifth rod 115.

The first end 201 of the first rod 111 inserts into the first port 251 of the bow yoke 116. The second end 202 of the first rod 111 inserts into the sixth port 256 of the stem yoke 117. The third end 203 of the second rod 112 inserts into the second port 252 of the bow yoke 116. The fourth end 204 of the second rod 112 inserts into the seventh port 257 of the stem yoke 117. The fifth end 205 of the third rod 113 inserts into the third port 253 of the bow yoke 116. The sixth end 206 of the third rod 113 inserts into the eighth port 258 of the stem yoke 117. The seventh end 207 of the fourth rod 114 inserts into the fourth port 254 of the bow yoke 116. The eighth end 208 of the fourth rod 114 inserts into the ninth port 259 of the stem yoke 117. The ninth end 209 of the fifth rod 115 inserts into the fifth port 255 of the bow yoke 116. The tenth end 210 of the fifth rod 115 inserts into the tenth port 260 of the stem yoke 117.

The first rod 111 and the second rod 112 are tightened into the bow yoke 116 and the stem yoke 117 by using the bow winch 118 to tighten the first elastic cord 181 and the second elastic cord 182. The third rod 113, the fourth rod 114, and the fifth rod 115 are tightened into the bow yoke 116 and the stem yoke 117 by using the aft winch 119 to tighten the third elastic cord 183, the fourth elastic cord 184, and the fifth elastic cord. Methods to use winches to tighten lines and structures are well known and documented in the mechanical arts.

Each of the one or more ribs 102 is an interior support structure that stabilizes the outer frame 101. Each of the one or more ribs 102 comprises a first rib strut 121, a second rib strut 122, a third rib strut 123, a fourth rib strut 124, a fifth rib strut 125, a sixth rib strut 126, a seventh rib strut 127, an eighth rib strut 128, a ninth rib strut 129, a first rib coupling 131, a second rib coupling 132, a third rib coupling 133, and a fourth rib coupling 134.

The first rib strut 121 is further defined with an eleventh end 211 and a twelfth end 212. The second rib strut 122 is further defined with a thirteenth end 213 and a fourteenth end 214. The third rib strut 123 is further defined with a fifteenth end 215 and a sixteenth end 216. The fourth rib strut 124 is further defined with a seventeenth end 217 and an eighteenth end 218. The fifth rib strut 125 is further defined with a nineteenth end 219 and a twentieth end 220. The sixth rib strut 126 is further defined with a twenty first end 221 and a twenty second end 222. The seventh rib strut 127 is further defined with a twenty third end 223 and a twenty fourth end 224. The eighth rib strut 128 is further defined with a twenty fifth end 225 and a twenty sixth end 226. The ninth rib strut 129 is further defined with a twenty seventh end 227 and a twenty eighth end 228.

The first rib coupling 131 is further defined with an eleventh port 261, a twelfth port 262, a thirteenth port 263, and a fourteenth port 264. The second rib coupling 132 is further defined with a fifteenth port 265, a sixteenth port 266, a seventeenth port 267, and an eighteenth port 268. The third rib coupling 133 is further defined with a nineteenth port 269 and a twentieth port 270. The fourth rib coupling 134 is further defined with a twenty first port 271 and a twenty second port 272.

The first rib strut 121 is a readily and commercially available flexible fiberglass shaft. The second rib strut 122 is a readily and commercially available flexible fiberglass shaft. The third rib strut 123 is a readily and commercially available flexible fiberglass shaft. The fourth rib strut 124 is a readily and commercially available flexible fiberglass shaft. The fifth rib strut 125 is a readily and commercially available flexible fiberglass shaft. The sixth rib strut 126 is a readily and commercially available flexible fiberglass shaft. The seventh rib strut 127 is a readily and commercially available flexible fiberglass shaft. The eighth rib strut 128 is a readily and commercially available flexible fiberglass shaft. The ninth rib strut 129 is a readily and commercially available flexible fiberglass shaft.

The first rib coupling 131 is a device that is used to attach two or more pipes or shafts together. In the first potential embodiment of the disclosure, the first rib coupling 131 is a custom made coupling formed from fiberglass. The second rib coupling 132 is a device that is used to attach two or more pipes or shafts together. In the first potential embodiment of the disclosure, the second rib coupling 132 is a custom made coupling formed from fiberglass. The third rib coupling 133 is a device that is used to attach two or more pipes or shafts together. In the first potential embodiment of the disclosure, the third rib coupling 133 is a custom made coupling formed from fiberglass. The fourth rib coupling 134 is a device that is used to attach two or more pipes or shafts together. In the first potential embodiment of the disclosure, the fourth rib coupling 134 is a custom made coupling formed from fiberglass. The use of couplings to attach pipes to each other is well known and documented in the plumbing arts.

Figure 2:
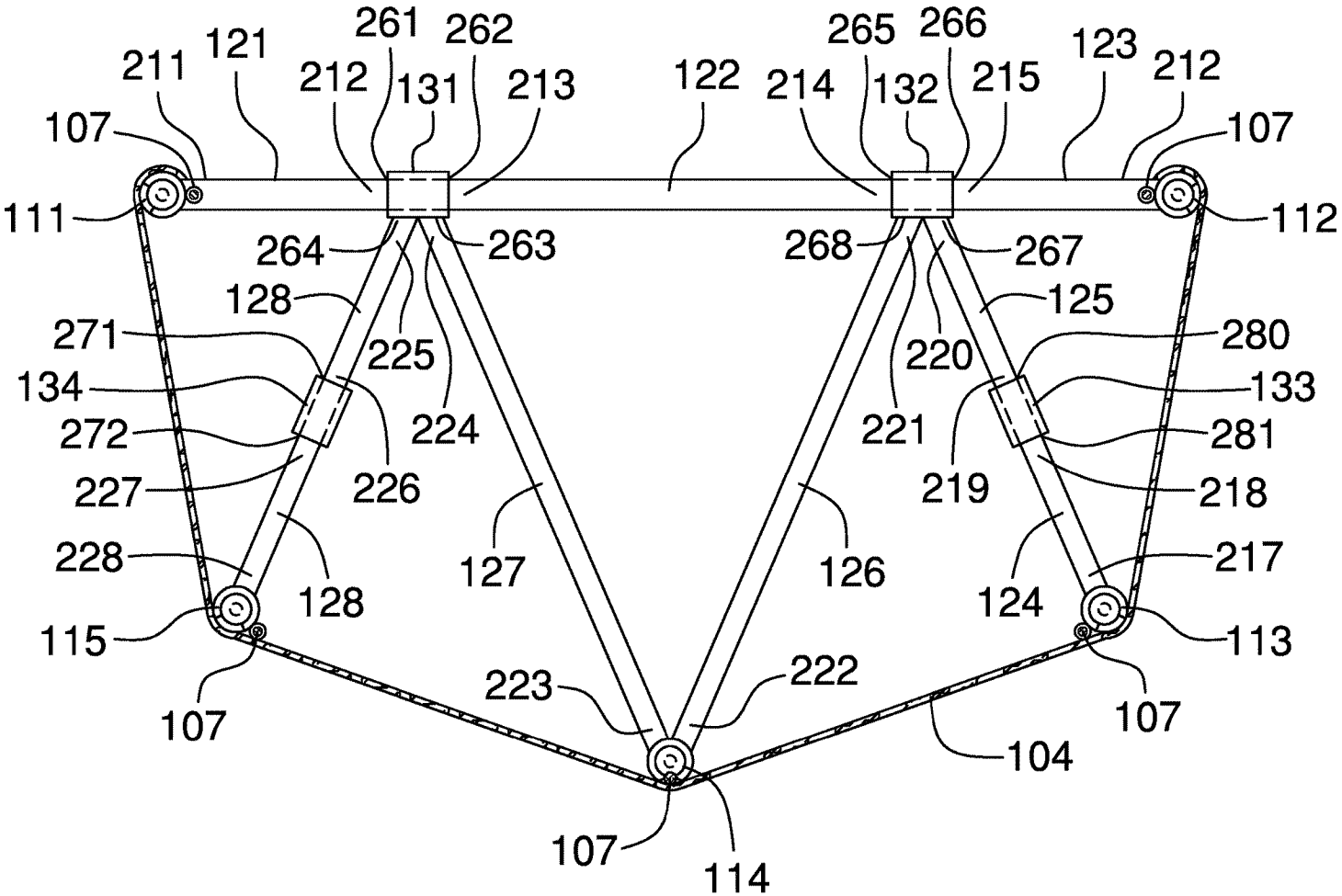
FIG. 2 is a cross-sectional view of an embodiment of the disclosure across 2-2 as shown in FIG. 1.
Figure 3:
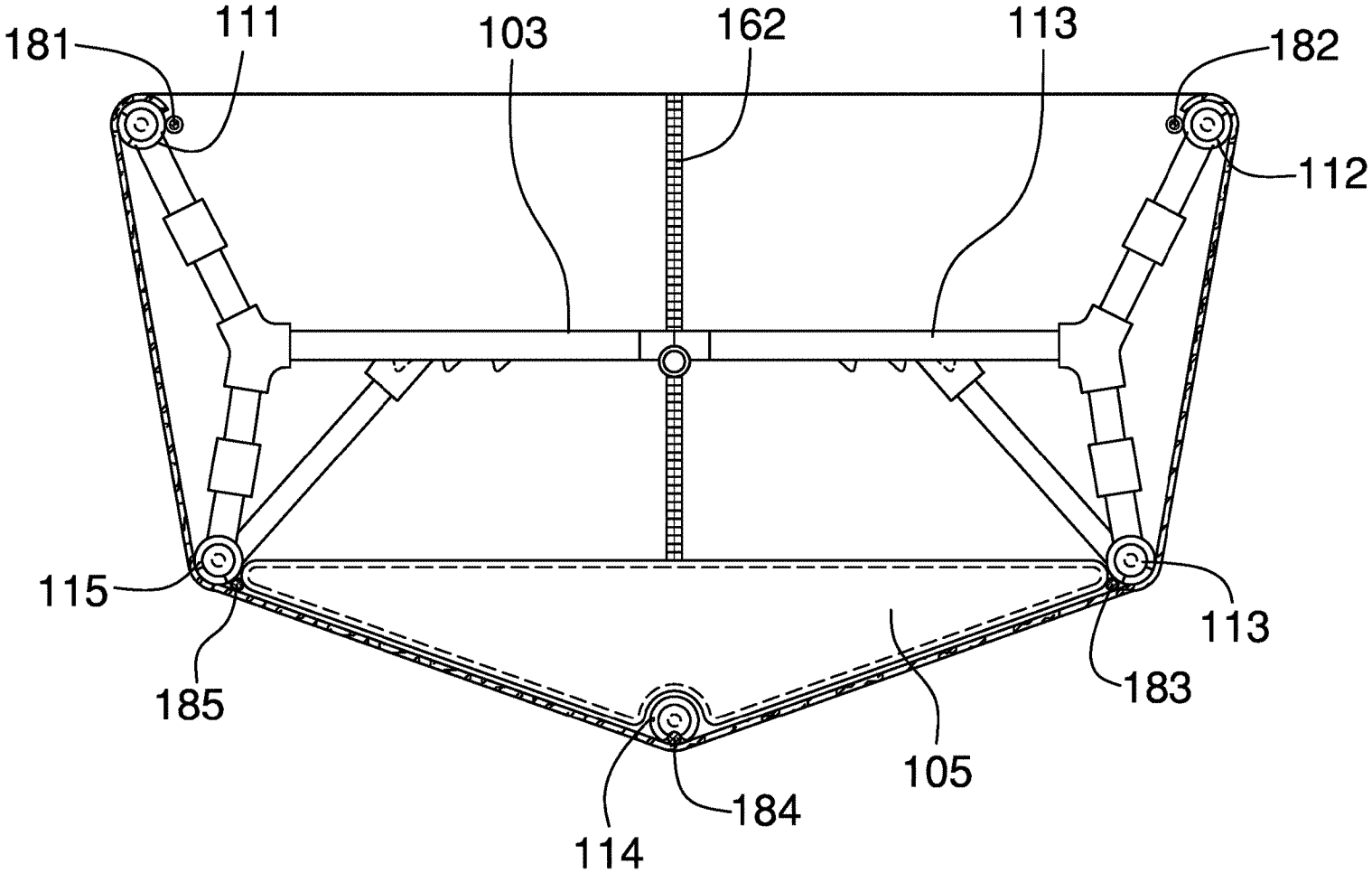
FIG. 3 is a cross-sectional view of an embodiment of the disclosure across 3-3 as shown in FIG. 1.

As shown most clearly in FIG. 2, the assembly of each of the one or more ribs to form a normal bottom for the invention 100 is described in this paragraph. The eleventh end 211 of the first rib strut 121 attaches to the first rod 111. The twelfth end of the first rib strut 121 attaches to the eleventh port 261 of the first rib coupling 131. The thirteenth end 213 of the second rib strut 122 attaches to the twelfth port 262 of the first rib coupling 131. The fourteenth end 214 of the second rib strut 122 attaches to the fifteenth port 265 of the second rib coupling 132. The fifteenth end 215 of the third rib strut 123 attaches to the sixteenth port 266 of the second rib coupling 132. The sixteenth end 216 of the third rib strut 123 attaches to the second rod 112. The seventeenth end 217 of the fourth rib strut 124 attaches to the third rod 113. The eighteenth end 218 of the fourth rib strut 124 attaches to the nineteenth port 269 of the third rib coupling 133. The nineteenth end 219 of the fifth rib strut 125 attaches to the twentieth port 270 of the third rib coupling 133. The twentieth end 220 of the fifth rib strut 125 attaches to the seventeenth port 267 of the second rib coupling 132. The twenty first end 221 of the sixth rib strut 126 attaches to the eighteenth port 268 of the second rib coupling 132. The twenty second end 222 of the sixth rib strut 126 attaches to the fourth rod 114. The twenty third end 223 of the seventh rib strut 127 attaches to the fourth rod 114. The twenty fourth end 224 of the seventh rib strut 127 attaches to the thirteenth port 263 of the first rib coupling 131. The twenty fifth end 225 of the eighth rib strut 128 attaches to the fourteenth port 264 of the first rib coupling 131. The twenty sixth end 226 of the eighth rib strut 128 attaches to the twenty first port 271 of the fourth rib coupling 134. The twenty seventh end 227 of the ninth rib strut 129 attaches to the twenty second port 272 of the fourth rib coupling 134. The twenty eighth end 228 of the ninth rib strut 129 attaches to the fifth rod 115.

Figure 6:
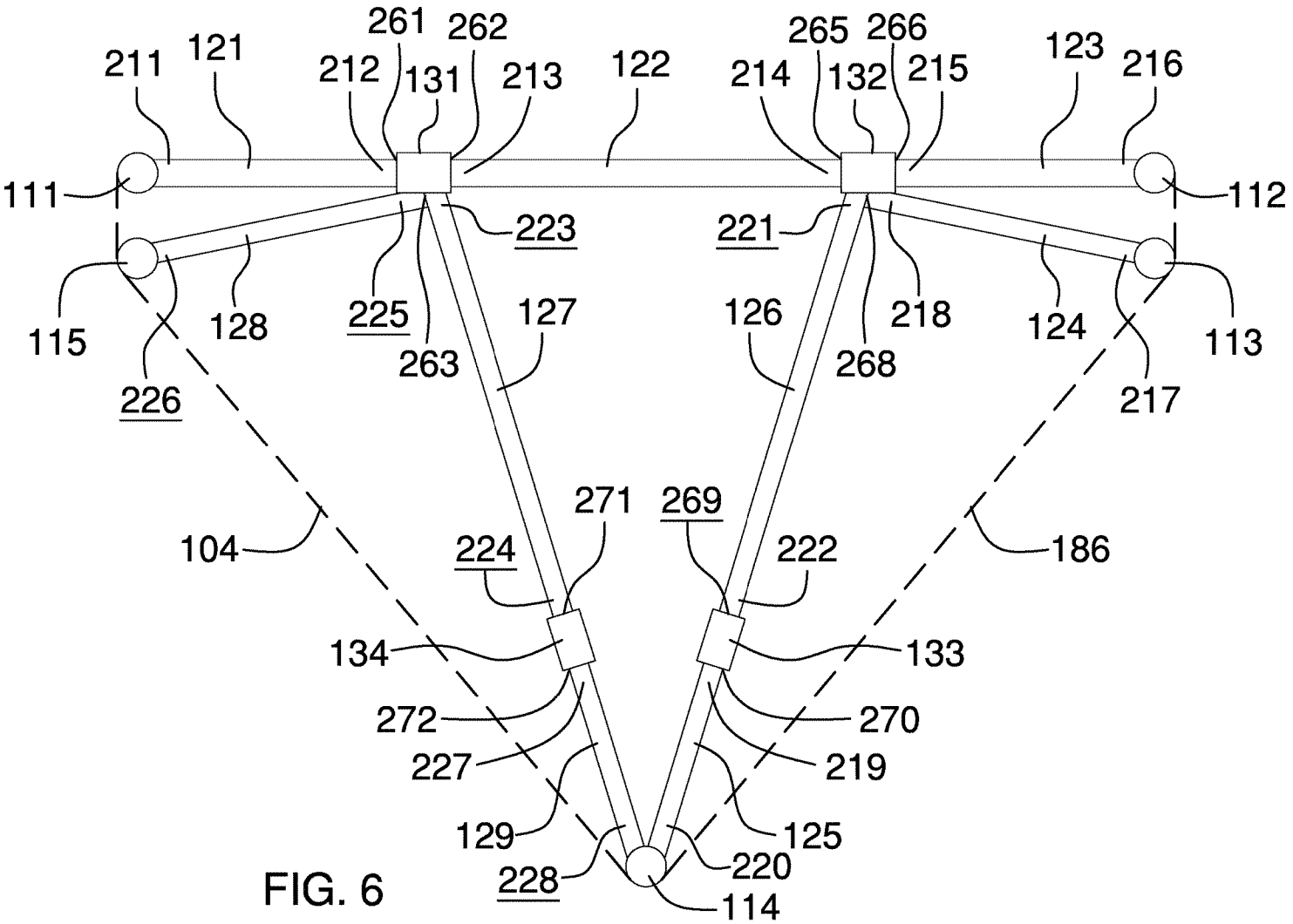
FIG. 6 is a detail view of an embodiment of the disclosure.

As shown most clearly in FIG. 6, the assembly of each of the one or more ribs to form a deep bottom with a V shape for the invention 100 is described in this paragraph. The eleventh end 211 of the first rib strut 121 attaches to the first rod 111. The twelfth end 212 of the first rib strut 121 attaches to the eleventh port 261 of the first rib coupling 131. The thirteenth end 213 of the second rib strut 122 attaches to the twelfth port 262 of the first rib coupling 131. The fourteenth end of the second rib strut 122 attaches to the fifteenth port 265 of the second rib coupling 132. The fifteenth end 215 of the third rib strut 123 attaches to the sixteenth port 266 of the second rib coupling 132. The sixteenth end 216 of the third rib strut 123 attaches to the second rod 112. The seventeenth end 217 of the fourth rib strut 124 attaches to the third rod 113. The eighteenth end 218 of the fourth rib strut 124 attaches to the seventeenth port 267 of the second rib coupling 132. The twenty first end 221 of the sixth rib strut 126 attaches to the eighteenth port 268 of the second rib coupling 132.

The twenty second end 222 of the sixth rib strut 126 attaches to the nineteenth port 269 of the third rib coupling 133. The nineteenth end 219 of the fifth rib strut 125 attaches to the twentieth port 270 of the third rib coupling 133. The twentieth end 220 of the fifth rib strut 125 attaches to the fourth rod 114. The twenty eighth end 228 of the ninth rib strut 129 attaches to the fourth rod 114. The twenty seventh end 227 of the ninth rib strut 129 attaches to the twenty second port 272 of the fourth rib coupling 134. The twenty fourth end of the seventh rib strut 127 attaches to the twenty first port 271 of the fourth rib coupling 134. The twenty third end 223 of the seventh rib strut 127 attaches to the thirteenth port 263 of the first rib coupling 131. The twenty fifth end 225 of the eighth rib strut 128 attaches to the fourteenth port 264 of the first rib coupling 131. The twenty sixth end 226 of the eighth rib strut 128 attaches to the fifth rod 115.

Figure 7:
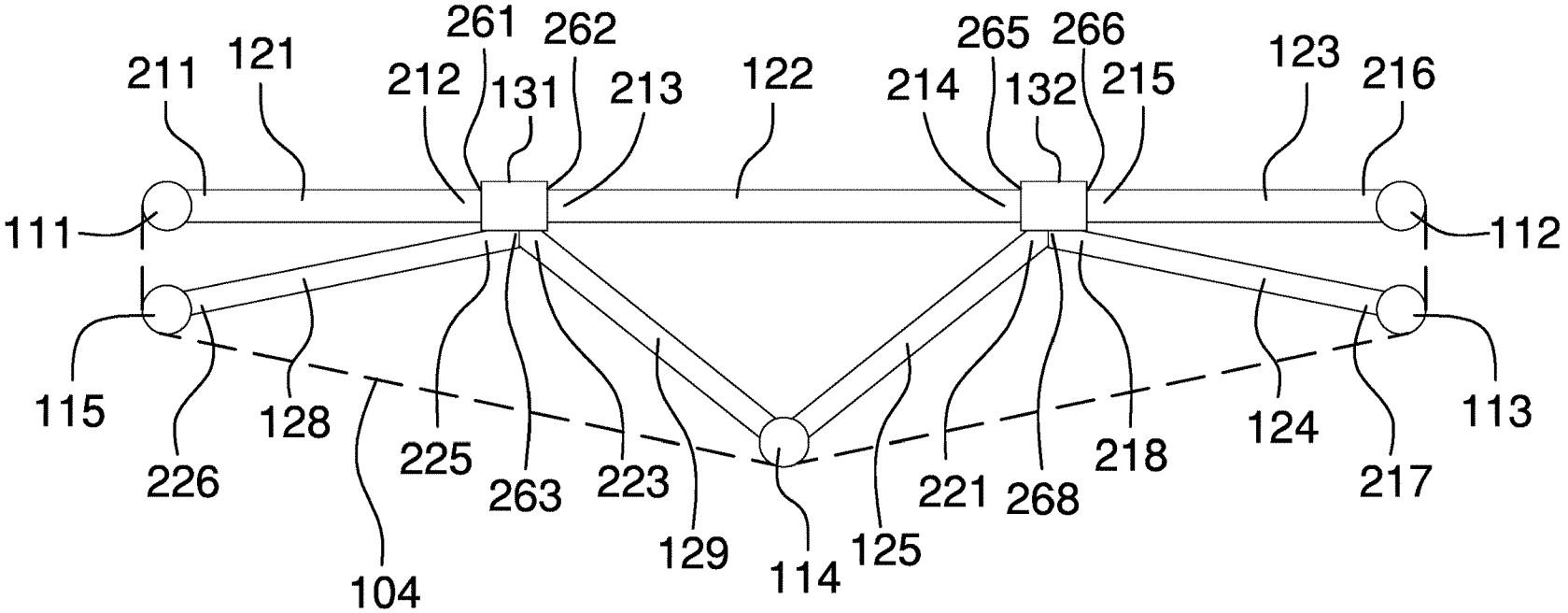
FIG. 7 is a detail view of an embodiment of the disclosure.

As shown most clearly in FIG. 7, the assembly of each of the one or more ribs to form a flat bottom for the invention 100 is described in this paragraph. The eleventh end 211 of the first rib strut 121 attaches to the first rod 111. The sixth rib strut 126, the seventh rib strut 127, the third rib coupling 133 and the fourth rib coupling 134 are not used in this configuration. The twelfth end 212 of the first rib strut 121 attaches to the eleventh port 261 of the first rib coupling 131. The thirteenth end 213 of the second rib strut 122 attaches to the twelfth port 262 of the first rib coupling 131. The fourteenth end 214 of the second rib strut 122 attaches to the fourteenth port 264 of the second rib coupling 132. The fifteenth end 215 of the third rib strut 123 attaches to the sixteenth port 266 of the second rib coupling 132. The sixteenth end 216 of the third rib strut 123 attaches to the second rod 112. The seventeenth end 217 of the fourth rib strut 124 attaches to the third rod 113. The eighteenth end 218 of the fourth rib strut 124 attaches to the seventeenth port 267 of the second rib coupling 132. The nineteenth end 219 of the fifth rib strut 125 attaches to the eighteenth port 268 of the second rib coupling 132. The twentieth end 220 of the fifth rib strut 125 attaches to the fourth rod 114. The twenty eighth end 228 of the ninth rib strut 129 attaches to the fourth rod 114. The twenty seventh end 227 of the ninth rib strut 129 attaches to the thirteenth port 263 of the first rib coupling 131. The twenty fifth end 225 of the eighth rib strut 128 attaches to the fourteenth port 264 of the first rib coupling 131. The twenty sixth end 226 of the eighth rib strut 128 attaches to the fifth rod 115.

Each of the one or more seats 103 is a structure formed within the interior of the invention 100 that forms a surface upon which a person may sit. The each individual seat of the one or more seats 103 comprises a first seat strut 141, a second seat strut 142, a third seat strut 143, a fourth seat strut 144, a fifth seat strut 145, a sixth seat strut 146, a seventh seat strut 147, an eighth seat strut 148, a ninth seat strut 149, a tenth seat strut 150, a first seat coupling 151, a second seat coupling 152, a third seat coupling 153, a fourth seat coupling 154, a fifth seat coupling 155, a sixth seat coupling 156, a seventh seat coupling 157, an eighth seat coupling 158, and a seating plate 159. Wherein each of the one or more seats 103 is identical.

The first seat strut 141 is further defined with a twenty ninth end 229 and a thirtieth end 230. The second seat strut 142 is further defined with a thirty first end 231 and a thirty second end 232. The third seat strut 143 is further defined with a thirty third end 233 and a thirty fourth end 234. The fourth seat strut 144 is further defined with a thirty fifth end 235 and a thirty sixth end 236. The fifth seat strut 145 is further defined with a thirty seventh end 237 and a thirty eighth end 238. The sixth seat strut 146 is further defined with a thirty ninth end 239 and a fortieth end 240. The seventh seat strut 147 is further defined with a forty first end 241 and a forty second end 242. The eighth seat strut 148 is further defined with a forty third end 243 and a forty fourth end 244. The ninth seat strut 149 is further defined with a forty fifth end 245 and a forty sixth end 246. The tenth seat strut 150 is further defined with a forty seventh end 247 and a forty eighth end 248.

The first seat coupling 151 is further defined with a twenty third port 273 and a twenty fourth port 274. The second seat coupling 152 is further defined with a twenty fifth port 275 and a twenty sixth port 276. The third seat coupling 153 is further defined with a twenty seventh port 277, a twenty eighth port 278, and a twenty ninth port 279. The fourth seat coupling 154 is further defined with a thirtieth port 280 and a thirty first port 281. The fifth seat coupling 155 is further defined with a thirty second port 282. The sixth seat coupling 156 is further defined with a thirty third port 283. The seventh seat coupling 157 is further defined with a thirty fourth port 284 and a thirty fifth port 285. The eighth seat coupling 158 is further defined with a thirty sixth port 286, a thirty seventh port 287, and a thirty eighth port 288.

The first seat strut 141 is a readily and commercially available flexible fiberglass shaft. The second seat strut 142 is a readily and commercially available flexible fiberglass shaft. The third seat strut 143 is a readily and commercially available flexible fiberglass shaft. The fourth seat strut 144 is a readily and commercially available flexible fiberglass shaft. The fifth seat strut 145 is a readily and commercially available flexible fiberglass shaft. The sixth seat strut 146 is a readily and commercially available flexible fiberglass shaft. The seventh seat strut 147 is a readily and commercially available flexible fiberglass shaft. The eighth seat strut 148 is a readily and commercially available flexible fiberglass shaft. The ninth seat strut 149 is a readily and commercially available flexible fiberglass shaft. The tenth seat strut 150 is a readily and commercially available flexible fiberglass shaft.

The first seat coupling 151 is a device that is used to attach two or more pipes or shafts together. In the first potential embodiment of the disclosure, the first seat coupling 151 is a custom made coupling formed from fiberglass. The second seat coupling 152 is a device that is used to attach two or more pipes or shafts together. In the first potential embodiment of the disclosure, the second seat coupling 152 is a custom made coupling formed from fiberglass. The third seat coupling 153 is a device that is used to attach two or more pipes or shafts together. In the first potential embodiment of the disclosure, the third seat coupling 153 is a custom made coupling formed from fiberglass. The fourth seat coupling 154 is a device that is used to attach two or more pipes or shafts together. In the first potential embodiment of the disclosure, the fourth seat coupling 154 is a custom made coupling formed from fiberglass. The fifth seat coupling 155 is a device that is used to attach two or more pipes or shafts together. In the first potential embodiment of the disclosure, the fifth seat coupling 155 is a custom made coupling formed from fiberglass. The sixth seat coupling 156 is a device that is used to attach two or more pipes or shafts together. In the first potential embodiment of the disclosure, the sixth seat coupling 156 is a custom made coupling formed from fiberglass. The seventh seat coupling 157 is a device that is used to attach two or more pipes or shafts together. In the first potential embodiment of the disclosure, the seventh seat coupling 157 is a custom made coupling formed from fiberglass. The eighth seat coupling 158 is a device that is used to attach two or more pipes or shafts together. In the first potential embodiment of the disclosure, the eighth seat coupling 158 is a custom made coupling formed from fiberglass. The use of couplings to attach pipes to each other is well known and documented in the plumbing arts.

In the first potential embodiment of the disclosure, the first seat strut 141, the second seat strut 142 and the first seat coupling 151 are formed in a telescopic manner such that the seat elevation may be adjusted. The third seat strut 143, the fourth seat strut 144 and the second seat coupling 152 are formed in a telescopic manner such that the seat elevation may be adjusted.

The seating plate 159 is a plate structure that physically provides the horizontal surface upon which a person may sit.

Figure 8:
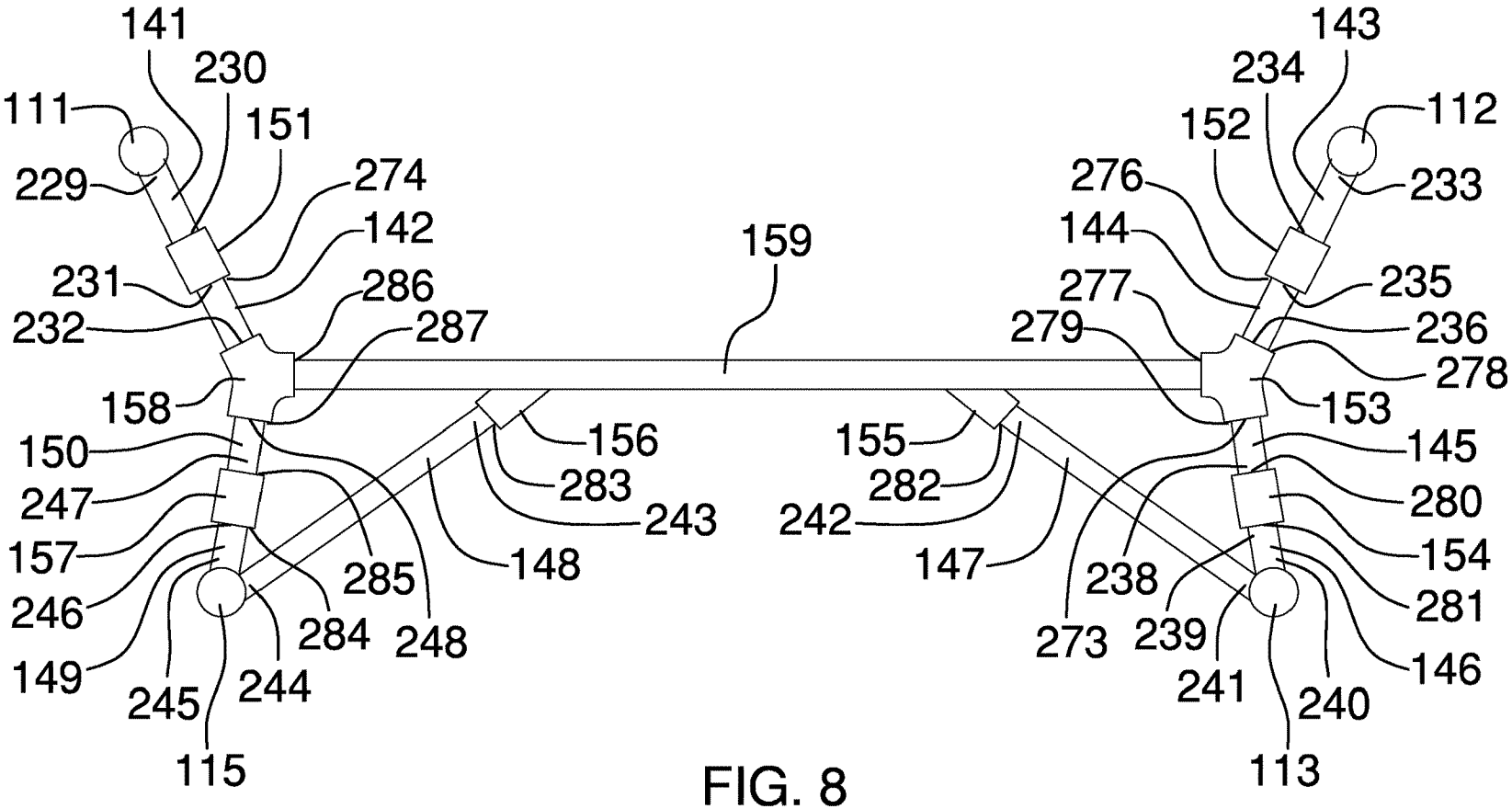
FIG. 8 is a detail view of an embodiment of the disclosure.

As shown most clearly in FIG. 8, each of the one or more seats 103 are assembled as described in this paragraph. The thirty sixth port 286 of the eighth seat coupling 158 attaches to the seating plate 159. The twenty seventh port 277 of the third seat coupling 153 attaches to the seating plate 159. The fifth seat coupling 155 attaches to the seating plate 159. The sixth seat coupling 156 attaches to the seating plate 159. The twenty ninth end 229 of the first seat strut 141 attaches to the first rod 111. The thirtieth end 230 of the first seat strut 141 attaches to the twenty third port 273 of the first seat coupling 151. The thirty first end 231 of the second seat strut 142 attaches to the twenty fourth port 274 of the first seat coupling 151. The thirty second end 232 of the second seat strut 142 attaches to the thirty eighth port 288 of the eighth seat coupling 158. The thirty third end 233 of the third seat strut 143 attaches to the second rod 112. The thirty fourth end 234 of the third seat strut 143 attaches to the twenty fifth port 275 of the second seat coupling 152. The thirty fifth end 235 of the fourth seat strut 144 attaches to the twenty sixth port 276 of the second seat coupling 152. The thirty sixth end 236 of the fourth seat strut 144 attaches to the twenty eighth port 278 of the third seat coupling 153. The thirty seventh end 237 of the fifth seat strut 145 attaches to the twenty ninth port 279 of the third seat coupling 153. The thirty eighth end 238 of the fifth seat strut 145 attaches to the thirtieth port 280 of the fourth seat coupling 154. The thirty ninth end 239 of the sixth seat strut 146 attaches to the thirty first port 281 of the fourth seat coupling 154. The fortieth end 240 of the sixth seat strut 146 attaches to the third rod 113. The forty first end 241 of the seventh seat strut 147 attaches to the third rod 113. The forty second end 242 of the seventh seat strut 147 attaches to the thirty second port 282 of the fifth seat coupling 155. The forty third end 243 of the eighth seat strut 148 attaches to the thirty third port 283 of the sixth seat coupling 156. The forty fourth end 244 of the eighth seat strut 148 attaches to the fifth rod 115. The forty fifth end of the ninth seat strut 149 attaches to the fifth rod 115. The forty sixth end 246 of the ninth seat strut 149 attaches to the thirty fourth port 284 of the seventh seat coupling 157. The forty seventh end 247 of the tenth seat strut 150 attaches to the thirty fifth port 285 of the seventh seat coupling 157. The forty eighth end 248 of the tenth seat strut 150 attaches to the thirty seventh port 287 of the eighth seat coupling 158.

The outer shell 104 forms the exterior surface of the invention 100. The outer shell 104 is formed from water impermeable elastic material that creates a dry interior space within the invention 100 when the outer shell 104 is in its relaxed shape. In the first potential embodiment of the disclosure, the outer shell 104 is formed from a sheeting material comprising polyurethane. The outer shell 104 comprises a first zipper 161 and a second zipper 162. The first zipper 161 is a readily and commercially available zipper that is installed in the outer shell 104. The second zipper 162 is a readily and commercially available zipper that is installed in the outer shell 104. The first zipper 161 and the second zipper 162 are installed in the outer shell 104 such that the outer shell 104 can be folded into a portable container that can be used to carry the balance of the invention 100 when the invention 100 is not in use.

The flooring bladder 105 is a collapsible structure formed from an inflatable membrane. The flooring bladder 105 is sized to fit within the interior of the invention 100 such that the flooring bladder 105 forms a horizontal flooring surface within the interior space of the invention 100. Methods to form inflatable bladders are well known and documented in the mechanical and textile arts.

Each of the plurality of paddles 106 is a light weight paddle that is used to move the invention 100 while the invention 100 is floating in water. The plurality of paddles 106 comprises a handle 171, a blade frame 172, and a blade glove 173. The handle 171 is a shaft that is used to manipulate each of the plurality of paddles 106. The blade frame 172 is a flat oval structure that provides the rigidity required by a paddle blade. The blade glove 173 is a polyurethane bag. The blade glove 173 is sized such that the blade glove 173 will fit tightly over the blade frame 172 when the blade glove 173 is in its relaxed shape. When in use, the blade glove 173 forms a water impermeable surface that can be used for paddling the invention 100.

The following definitions were used in this disclosure:

Anchor: As used in this disclosure, anchor means to hold an object firmly or securely.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, and rope are synonyms for cord. Ferrule: As used in this disclosure, a ferrule is a cylindrical device that is used to interconnect pipes in a tent pole configuration.

Elastic: As used in this disclosure, an elastic is a material or object that deforms when a force is applied to it and that is able to return to its original shape after the force is removed. A material that exhibits these qualities is also referred to as an elastomeric material.

Elastic Cord: As used in this disclosure, an elastic cord is a cord that contains elastic yarns as some of the yarns that make up the cord. An elastic cord is constructed such that the elastic cord will stretch when a force is applied and will return to its original shape when after the force is removed. Shock cord and bungee cord are synonyms for elastic cord.

Exterior: As used in this disclosure, the exterior is use as a relational term that implies that an object is not contained within the boundary of a structure or a space.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Interior: As used in this disclosure, the interior is use as a relational term that implies that an object is contained within the boundary of a structure or a space.

Relaxed Shape: As used in this disclosure, a structure is considered to be in its relaxed state when no shear, strain, or torsional forces are being applied to the structure.

Sheeting: As used in this disclosure, sheeting is a material, such as a textile, a plastic, or a metal foil, in the form of a thin flexible layer or layers.

Telescopic: As used in this disclosure, telescopic is an adjective that describes an object made of sections that fit or slide into each other such that the object can be made longer or shorter by adjusting the relative positions of the sections.

Tent Pole Configuration: As used in this disclosure, a tent pole configuration is a method of interconnecting a plurality of pipes (or other hollow tubular objects). With the exception of the span of the length of the center axis of the pipe, each pipe contained in the plurality of pipes is otherwise identical to the pipes remaining in the plurality of pipes. In a tent pole configuration, each of the plurality of pipes is fitted with a ferrule. The ferrule is a cylindrical object that is attached to an end of each pipe such that the center axis of the ferrule is aligned with the center axis of the pipe. The outer diameter of the ferrule is less than the inner diameter of the pipe. To interconnect the plurality of pipes into a tent pole configuration, the ferrule of a first pipe selected from the plurality of pipes is inserted into the non-ferrule end of a second pipe selected from the plurality of pipes. This process is continued until all the pipes contained within the plurality of pipes are interconnected.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A configurable water vessel comprising:

wherein the configurable water vessel comprises an outer frame, one or more ribs, one or more seats, an outer shell, a flooring bladder, a plurality of paddles, and a plurality of elastic cords;

wherein the outer shell provides a barrier between an interior of the configurable water vessel and the water within which the configurable water vessel is placed;

wherein the outer frame, the one or more ribs, the one or more seats, the flooring bladder, and the plurality of elastic cords form a physical structure upon which the outer shell attaches;

wherein the plurality of paddles provides motive power for the configurable water vessel;

wherein the configurable water vessel is a portable boat;

wherein the configurable water vessel is stored as a backpack;

wherein the configurable water vessel is configured for use in water;

wherein the configurable water vessel can be deployed with a bottom configuration selected from a group consisting of a normal bottom, a deep V bottom, and a flat bottom;

wherein the outer frame is a rigid structure;

wherein the outer frame comprises a plurality of fiberglass rods;

wherein each of the plurality of fiberglass rods comprises a plurality of fiberglass pipes and an elastic cord selected from the plurality of elastic cords;

wherein each of the plurality of fiberglass pipes is a flexible fiberglass pipe;

wherein the plurality of elastic cords comprises a first elastic cord, a second elastic cord, a third elastic cord, a fourth elastic cord, and a fifth elastic cord;

wherein the plurality of fiberglass rods comprises a first rod, a second rod, a third rod, a fourth rod, and a fifth rod;

wherein the first rod is further defined with a first end and a second end;

wherein the second rod is further defined with a third end and a fourth end;

wherein the third rod is further defined with a fifth end and a sixth end;

wherein the fourth rod is further defined with a seventh end and an eighth end;

wherein the fifth rod is further defined with a ninth end and a tenth end;

wherein the outer frame is a rigid structure;

wherein the outer frame further comprises a bow yoke and a stem yoke;

wherein the bow yoke is a structure that forms the bow of the configurable water vessel;

wherein the bow yoke anchors an end of each of the plurality of fiberglass rods;

wherein the bow yoke is further defined with a first port, a second port, a third port, a fourth port, and a fifth port;

wherein the stem yoke is a structure that forms the stem of the configurable water vessel;

wherein the stem yoke is used to anchor an end of each of the plurality of fiberglass rods;

wherein the stem yoke is further defined with a sixth port, a seventh port, an eighth port, a ninth port, and a tenth port;

wherein the outer frame further comprises a bow winch and an aft winch, the bow winch tightens the first rod 111 and second rod 112 into the bow yoke and stem yoke by tightening the first and second elastic cords; and the third rod, fourth rod and fifth rod are tightened into the bow yoke and stem yoke by using the aft winch to tighten the third, fourth and fifth elastic cords;

wherein each of the plurality of fiberglass pipes is a hollow pipe;

wherein the plurality of fiberglass pipes that make up the selected fiberglass rod can be joined end to end in a tent pole configuration;

wherein a ferrule of a first selected fiber glass pipe is inserted into the hollow center of a second fiberglass pipe.

2. The configurable water vessel according to claim 1 wherein the selected elastic cord is threaded along the plurality of fiberglass pipes such that the selected elastic cord will hold the selected fiberglass rod together;

wherein the selected elastic cord is threaded along the plurality of fiberglass pipes such that the selected elastic cord can be tightened by a winch selected from the bow winch and the aft winch such that the structure of the outer frame is rigidly formed;

wherein the selected winch tightens each of the plurality of elastic cords in a manner that secures each of the plurality of fiberglass rods to both the bow yoke and the stem yoke.

3. The configurable water vessel according to claim 2 wherein the first elastic cord is threaded along the first rod;

wherein the second elastic cord is threaded along the second rod;

wherein the third elastic cord is threaded along the third rod;

wherein the fourth elastic cord is threaded along the fourth rod;

wherein the fifth elastic cord is threaded along the fifth rod;

wherein the first end of the first rod inserts into the first port of the bow yoke;

wherein the second end of the first rod inserts into the sixth port of the stem yoke;

wherein the third end of the second rod inserts into the second port of the bow yoke;

wherein the fourth end of the second rod inserts into the seventh port of the stem yoke;

wherein the fifth end of the third rod inserts into the third port of the bow yoke;

wherein the sixth end of the third rod inserts into the eighth port of the stem yoke;

wherein the seventh end of the fourth rod inserts into the fourth port of the bow yoke;

wherein the eighth end of the fourth rod inserts into the ninth port of the stem yoke;

wherein the ninth end of the fifth rod inserts into the fifth port of the bow yoke;

wherein the tenth end of the fifth rod inserts into the tenth port of the stem yoke.

4. The configurable water vessel according to claim 3 wherein each of the one or more ribs is an interior support structure that stabilizes the outer frame.

5. The configurable water vessel according to claim 4 wherein each of the one or more seats is a structure formed within the interior of the configurable water vessel that forms a horizontal surface;

wherein each of the one or more seats is identical.

6. The configurable water vessel according to claim 5 wherein the each individual seat of the one or more seats comprises a first seat strut, a second seat strut, a third seat strut, a fourth seat strut, a fifth seat strut, a sixth seat strut, a seventh seat strut, an eighth seat strut, a ninth seat strut, a tenth seat strut, a first seat coupling, a second seat coupling, a third seat coupling, a fourth seat coupling, a fifth seat coupling, a sixth seat coupling, a seventh seat coupling, an eighth seat coupling, and a seating plate;

wherein the first seat strut is further defined with a twenty ninth end and a thirtieth end;

wherein the second seat strut is further defined with a thirty first end and a thirty second end;

wherein the third seat strut is further defined with a thirty third end and a thirty fourth end;

wherein the fourth seat strut is further defined with a thirty fifth end and a thirty sixth end;

wherein the fifth seat strut is further defined with a thirty seventh end and a thirty eighth end;

wherein the sixth seat strut is further defined with a thirty ninth end and a fortieth end;

wherein the seventh seat strut is further defined with a forty first end and a forty second end;

wherein the eighth seat strut is further defined with a forty third end and a forty fourth end;

wherein the ninth seat strut is further defined with a forty fifth end and a forty sixth end;

wherein the tenth seat strut is further defined with a forty seventh end and a forty eighth end;

wherein the first seat coupling is further defined with a twenty third port and a twenty fourth port;

wherein the second seat coupling is further defined with a twenty fifth port and a twenty sixth port;

wherein the third seat coupling is further defined with a twenty seventh port, a twenty eighth port, and a twenty ninth port;

wherein the fourth seat coupling is further defined with a thirtieth port and a thirty first port;

wherein the fifth seat coupling is further defined with a thirty second port;

wherein the sixth seat coupling is further defined with a thirty third port;

wherein the seventh seat coupling is further defined with a thirty fourth port and a thirty fifth port;

wherein the eighth seat coupling is further defined with a thirty sixth port, a thirty seventh port, and a thirty eighth port;

wherein the first seat strut is a flexible fiberglass shaft;

wherein the second seat strut is a flexible fiberglass shaft;

wherein the third seat strut is a flexible fiberglass shaft;

wherein the fourth seat strut is a flexible fiberglass shaft;

wherein the fifth seat strut is a flexible fiberglass shaft;

wherein the sixth seat strut is a flexible fiberglass shaft;

wherein the seventh seat strut is a flexible fiberglass shaft;

wherein the eighth seat strut is a flexible fiberglass shaft;

wherein the ninth seat strut is a flexible fiberglass shaft;

wherein the tenth seat strut is a flexible fiberglass shaft;

wherein the first seat coupling is a device that is used to attach two or more pipes or shafts together;

wherein the second seat coupling is a device that is used to attach two or more pipes or shafts together;

wherein the third seat coupling is a device that is used to attach two or more pipes or shafts together;

wherein the fourth seat coupling is a device that is used to attach two or more pipes or shafts together;

wherein the fifth seat coupling is a device that is used to attach two or more pipes or shafts together;

wherein the sixth seat coupling is a device that is used to attach two or more pipes or shafts together;

wherein the seventh seat coupling is a device that is used to attach two or more pipes or shafts together;

wherein the eighth seat coupling is a device that is used to attach two or more pipes or shafts together;

wherein the seating plate is a plate structure that physically provides a horizontal surface.

7. The configurable water vessel according to claim 6 wherein the thirty sixth port of the eighth seat coupling attaches to the seating plate;

wherein the twenty seventh port of the third seat coupling attaches to the seating plate;

wherein the fifth seat coupling attaches to the seating plate;

wherein the sixth seat coupling attaches to the seating plate;

wherein the twenty ninth end of the first seat strut attaches to the first rod;

wherein the thirtieth end of the first seat strut attaches to the twenty third port of the first seat coupling;

wherein the thirty first end of the second seat strut attaches to the twenty fourth port of the first seat coupling;

wherein the thirty second end of the second seat strut attaches to the thirty eighth port of the eighth seat coupling;

wherein the thirty third end of the third seat strut attaches to the second rod;

wherein the thirty fourth end of the third seat strut attaches to the twenty fifth port of the second seat coupling;

wherein the thirty fifth end of the fourth seat strut attaches to the twenty sixth port of the second seat coupling;

wherein the thirty sixth end of the fourth seat strut attaches to the twenty eighth port of the third seat coupling;

wherein the thirty seventh end of the fifth seat strut attaches to the twenty ninth port of the third seat coupling;

wherein the thirty eighth end of the fifth seat strut attaches to the thirtieth port of the fourth seat coupling;

wherein the thirty ninth end of the sixth seat strut attaches to the thirty first port of the fourth seat coupling;

wherein the fortieth end of the sixth seat strut attaches to the third rod;

wherein the forty first end of the seventh seat strut attaches to the third rod;

wherein the forty second end of the seventh seat strut attaches to the thirty second port of the fifth seat coupling;

wherein the forty third end of the eighth seat strut attaches to the thirty third port of the sixth seat coupling;

wherein the forty fourth end of the eighth seat strut attaches to the fifth rod;

wherein the forty fifth end of the ninth seat strut attaches to the fifth rod;

wherein the forty sixth end of the ninth seat strut attaches to the thirty fourth port of the seventh seat coupling;

wherein the forty seventh end of the tenth seat strut attaches to the thirty fifth port of the seventh seat coupling;

wherein the forty eighth end of the tenth seat strut attaches to the thirty seventh port of the eighth seat coupling.

8. The configurable water vessel according to claim 7 wherein each of the one or more ribs comprises a first rib strut, a second rib strut, a third rib strut, a fourth rib strut, a fifth rib strut, a sixth rib strut, a seventh rib strut, an eighth rib strut, a ninth rib strut, a first rib coupling, a second rib coupling, a third rib coupling, and a fourth rib coupling;

wherein the first rib strut is further defined with an eleventh end and a twelfth end;

wherein the second rib strut is further defined with a thirteenth end and a fourteenth end;

wherein the third rib strut is further defined with a fifteenth end and a sixteenth end;

wherein the fourth rib strut is further defined with a seventeenth end and an eighteenth end;

wherein the fifth rib strut is further defined with a nineteenth end and a twentieth end;

wherein the sixth rib strut is further defined with a twenty first end and a twenty second end;

wherein the seventh rib strut is further defined with a twenty third end and a twenty fourth end;

wherein the eighth rib strut is further defined with a twenty fifth end and a twenty sixth end;

wherein the ninth rib strut is further defined with a twenty seventh end and a twenty eighth end;

wherein the first rib coupling is further defined with an eleventh port, a twelfth port, a thirteenth port, and a fourteenth port;

wherein the second rib coupling is further defined with a fifteenth port, a sixteenth port, a seventeenth port, and an eighteenth port;

wherein the third rib coupling is further defined with a nineteenth port and a twentieth port;

wherein the fourth rib coupling is further defined with a twenty first port and a twenty second port;

wherein the first rib strut is a flexible fiberglass shaft;

wherein the second rib strut is a flexible fiberglass shaft;

wherein the third rib strut is a flexible fiberglass shaft;

wherein the fourth rib strut is a flexible fiberglass shaft;

wherein the fifth rib strut is a flexible fiberglass shaft;

wherein the sixth rib strut is a flexible fiberglass shaft;

wherein the seventh rib strut is a flexible fiberglass shaft;

wherein the eighth rib strut is a flexible fiberglass shaft;

wherein the ninth rib strut is a flexible fiberglass shaft;

wherein the first rib coupling is a device that is used to attach two or more pipes or shafts together;

wherein the second rib coupling is a device that is used to attach two or more pipes or shafts together;

wherein the third rib coupling is a device that is used to attach two or more pipes or shafts together;

wherein the fourth rib coupling is a device that is used to attach two or more pipes or shafts together.

9. The configurable water vessel according to claim 8 wherein the eleventh end of the first rib strut attaches to the first rod;

wherein the twelfth end of the first rib strut attaches to the eleventh port of the first rib coupling;

wherein the thirteenth end of the second rib strut attaches to the twelfth port of the first rib coupling;

wherein the fourteenth end of the second rib strut attaches to the fifteenth port of the second rib coupling;

wherein the fifteenth end of the third rib strut attaches to the sixteenth port of the second rib coupling;

wherein the sixteenth end of the third rib strut attaches to the second rod;

wherein the seventeenth end of the fourth rib strut attaches to the third rod;

wherein the eighteenth end of the fourth rib strut attaches to the nineteenth port of the third rib coupling;

wherein the nineteenth end of the fifth rib strut attaches to the twentieth port of the third rib coupling;

wherein the twentieth end of the fifth rib strut attaches to the seventeenth port of the second rib coupling;

wherein the twenty first end of the sixth rib strut attaches to the eighteenth port of the second rib coupling;

wherein the twenty second end of the sixth rib strut attaches to the fourth rod;

wherein the twenty third end of the seventh rib strut attaches to the fourth rod;

wherein the twenty fourth end of the seventh rib strut attaches to the thirty sixth end of the first rib coupling;

wherein the twenty fifth end of the eighth rib strut attaches to the fourteenth port of the first rib coupling;

wherein the twenty sixth end of the eighth rib strut attaches to the twenty first port of the fourth rib coupling;

wherein the twenty seventh end of the ninth rib strut attaches to the twenty second port of the fourth rib coupling;

wherein the twenty eighth end of the ninth rib strut attaches to the fifth rod.

10. The configurable water vessel according to claim 9 wherein the outer shell forms the exterior surface of the configurable water vessel;

wherein the outer shell is formed from water impermeable elastic material that creates a dry interior space within the configurable water vessel when the outer shell is in its relaxed shape;

wherein the outer shell is formed from a sheeting material comprising polyurethane;

wherein the outer shell comprises a first zipper and a second zipper.

11. The configurable water vessel according to claim 10 wherein the flooring bladder is a collapsible structure formed from an inflatable membrane;

wherein the flooring bladder is sized to fit within the interior of the configurable water vessel such that the flooring bladder forms a horizontal flooring surface within the interior space of the configurable water vessel;

wherein the plurality of paddles comprises a handle, a blade frame, and a blade glove;

wherein the blade frame is a flat oval structure;

wherein the blade glove is a polyurethane bag;

wherein the blade glove is sized such that the blade glove will fit tightly over the blade frame when the blade glove is in its relaxed shape.

12. The configurable water vessel according to claim 8 wherein the eleventh end of the first rib strut attaches to the first rod;

wherein the twelfth end of the first rib strut attaches to the eleventh port of the first rib coupling;

wherein the thirteenth end of the second rib strut attaches to the second zipper of the first rib coupling;

wherein the fourteenth end of the second rib strut attaches to the fifteenth port of the second rib coupling;

wherein the fifteenth end of the third rib strut attaches to the sixteenth port of the second rib coupling;

wherein the sixteenth end of the third rib strut attaches to the second rod;

wherein the seventeenth end of the fourth rib strut attaches to the third rod;

wherein the eighteenth end of the fourth rib strut attaches to the seventeenth port of the second rib coupling;

wherein the twenty first end of the sixth rib strut attaches to the eighteenth port of the second rib coupling;

wherein the twenty second end of the sixth rib strut attaches to the nineteenth port of the third rib coupling;

wherein the nineteenth end of the fifth rib strut attaches to the twentieth port of the third rib coupling;

wherein the twentieth end of the fifth rib strut attaches to the fourth rod;

wherein the twenty eighth end of the ninth rib strut attaches to the fourth rod;

wherein the twenty seventh end of the ninth rib strut attaches to the twenty second port of the fourth rib coupling;

wherein the twenty fourth end of the seventh rib strut attaches to the twenty first port of the fourth rib coupling;

wherein the twenty third end of the seventh rib strut attaches to the thirteenth port of the first rib coupling;

wherein the twenty fifth end of the eighth rib strut attaches to the fourteenth port of the first rib coupling;

wherein the twenty sixth end of the eighth rib strut attaches to the fifth rod.

13. The configurable water vessel according to claim 12 wherein the outer shell forms the exterior surface of the configurable water vessel;

wherein the outer shell is formed from water impermeable elastic material that creates a dry interior space within the configurable water vessel when the outer shell is in its relaxed shape;

wherein the outer shell is formed from a sheeting material comprising polyurethane;

wherein the outer shell comprises a first zipper and a second zipper.

14. The configurable water vessel according to claim 13 wherein the flooring bladder is a collapsible structure formed from an inflatable membrane;

wherein the flooring bladder is sized to fit within the interior of the configurable water vessel such that the flooring bladder forms a horizontal flooring surface within the interior space of the configurable water vessel;

wherein the plurality of paddles comprises a handle, a blade frame, and a blade glove;

wherein the blade frame is a flat oval structure;

wherein the blade glove is a polyurethane bag;

wherein the blade glove is sized such that the blade glove will fit tightly over the blade frame when the blade glove is in its relaxed shape.

15. The configurable water vessel according to claim 8 wherein the eleventh end of the first rib strut attaches to the first rod;

wherein the sixth rib strut, the seventh rib strut, the third rib coupling and the fourth rib coupling are not used in this configuration;

wherein the twelfth end of the first rib strut attaches to the first zipper of the first rib coupling;

wherein the thirteenth end of the second rib strut attaches to the twelfth port of the first rib coupling;

wherein the fourteenth end of the second rib strut attaches to the fourteenth port of the second rib coupling;

wherein the fifteenth end of the third rib strut attaches to the sixteenth port of the second rib coupling;

wherein the sixteenth end of the third rib strut attaches to the second rod;

wherein the seventeenth end of the fourth rib strut attaches to the third rod;

wherein the eighteenth end of the fourth rib strut attaches to the seventeenth port of the second rib coupling;

wherein the nineteenth end of the fifth rib strut attaches to the eighteenth port of the second rib coupling;

wherein the twentieth end of the fifth rib strut attaches to the fourth rod;

wherein the twenty eighth end of the ninth rib strut attaches to the fourth rod;

wherein the twenty seventh end of the ninth rib strut attaches to the thirteenth port of the first rib coupling;

wherein the twenty fifth end of the eighth rib strut attaches to the fourteenth port of the first rib coupling;

wherein the twenty sixth end of the eighth rib strut attaches to the fifth rod.

16. The configurable water vessel according to claim 15 wherein the outer shell forms the exterior surface of the configurable water vessel;

wherein the outer shell is formed from water impermeable elastic material that creates a dry interior space within the configurable water vessel when the outer shell is in its relaxed shape;

wherein the outer shell is formed from a sheeting material comprising polyurethane;

wherein the outer shell comprises a first zipper and a second zipper.

17. The configurable water vessel according to claim 16 wherein the flooring bladder is a collapsible structure formed from an inflatable membrane;

wherein the flooring bladder is sized to fit within the interior of the configurable water vessel such that the flooring bladder forms a horizontal flooring surface within the interior space of the configurable water vessel;

wherein the plurality of paddles comprises a handle, a blade frame, and a blade glove;

wherein the blade frame is a flat oval structure;

wherein the blade glove is a polyurethane bag;

wherein the blade glove is sized such that the blade glove will fit tightly over the blade frame when the blade glove is in its relaxed shape.

* * * * *